US007708418B2

(12) United States Patent
Fabrizi

(10) Patent No.: US 7,708,418 B2
(45) Date of Patent: May 4, 2010

(54) SUPPORT FRAME FOR ELECTRICAL APPARATUSES

(75) Inventor: Fabrizio Fabrizi, Bergamo (IT)

(73) Assignee: Bticino S.p.A., Milan (IT)

( * ) Notice: Subject to any disclaimer, the term of this patent is extended or adjusted under 35 U.S.C. 154(b) by 244 days.

(21) Appl. No.: 11/910,894

(22) PCT Filed: Apr. 3, 2006

(86) PCT No.: PCT/IT2006/000217

§ 371 (c)(1),
(2), (4) Date: Dec. 12, 2007

(87) PCT Pub. No.: WO2006/106553

PCT Pub. Date: Oct. 12, 2006

(65) Prior Publication Data

US 2008/0273295 A1 Nov. 6, 2008

(30) Foreign Application Priority Data

Apr. 7, 2005 (IT) ..... RM2005A0164

(51) Int. Cl.
*F21V 33/00* (2006.01)

(52) U.S. Cl. ..... 362/95; 362/253

(58) Field of Classification Search ..... 362/95, 362/253

See application file for complete search history.

(56) References Cited

U.S. PATENT DOCUMENTS

| | | | | |
|---|---|---|---|---|
| 5,751,542 | A | 5/1998 | Holhammar | |
| 6,350,039 | B1 * | 2/2002 | Lee | 362/95 |
| 6,808,283 | B2 * | 10/2004 | Tsao | 362/95 |
| 6,883,927 | B2 * | 4/2005 | Cunningham et al. | 362/95 |

FOREIGN PATENT DOCUMENTS

| | | |
|---|---|---|
| DE | 18 33 265 U | 6/1961 |
| DE | 34 10 344 A1 | 10/1985 |
| DE | 36 43 702 C1 | 8/1987 |
| DE | 88 01 219 U1 | 3/1988 |
| DE | 38 28 177 A1 | 3/1990 |
| DE | 102 46 399 B3 | 2/2004 |
| EP | 0 989 574 A1 | 3/2000 |
| GB | 2 359 202 | 8/2001 |

* cited by examiner

*Primary Examiner*—David V Bruce
(74) *Attorney, Agent, or Firm*—Hogan & Hartson LLP

(57) ABSTRACT

The present invention refers to a support frame (1) for wall-mounting one or more electrical apparatuses, the frame comprising a frame body (2) that can be fixed to a wall and extending around an opening (5) defining a mounting seat suitable for receiving and holding one or more electrical apparatuses. The support frame (1) is characterised in that it also includes: —at least one optical source (7.1, 7.2) suitable for generating an optical signal; —an electrical circuit (20, 10) connected to said optical source (7.1, 7.2) to supply it with an electrical power supply signal, —means (16.1, 16.2, 16.3) for housing said electrical circuit (20, 10) and said source (7.1, 7.2), foreseen in said frame body (2), the frame body (2) allowing the propagation of at least one part of said optical signal towards the outside of said body.

11 Claims, 2 Drawing Sheets

SUPPORT FRAME FOR ELECTRICAL APPARATUSES

CROSS-REFERENCE TO RELATED APPLICATIONS

The present application is a national filing in the U.S. Patent & Trademark Office of PCT/IT2006/000217 filed Apr. 3, 2006, and claims priority of Italy Patent Application No. RM2005A000164 filed Apr. 7, 2005, both of which applications are incorporated herein in their entireties by this reference.

FIELD OF THE INVENTION

The present invention refers to the technical field of electric installations of dwellings and offices, and more specifically, concerns a support frame for wall-mounting an electrical apparatus.

BACKGROUND OF THE INVENTION

For the purposes of the present description, by electrical apparatus we mean, in general, any means or electrical device generally forming part of electric installations in civil buildings and the like and usually intended to be mounted, for example built in, onto walls of such buildings.

This definition therefore includes, not limitingly, switches, electrical power sockets, sockets for data networks, TV sockets, telephone sockets, buttons, commutators, deviators, electrical adjustment devices in general, connectors, thermostats, timers, fuse-boxes, alarms/buzzers, emergency lights (for example removable), indicator lights (for example guidance lights), displays (for example LCD) and the like.

As known, many of the aforementioned electrical apparatuses are usually installed on a wall using composite mounting structures, or groups of parts, generally including:

- a box intended to be built into the wall;
- a apparatus-carrying mounting frame (or support frame) that can be fixed to the box and comprising a frame body extending around an opening defining a mounting seat suitable for receiving and holding one or more electrical apparatuses; and
- a cover plate that can be fixed to the frame and provided with an opening to allow a user to gain access, visually or manually, to the electrical apparatuses installed on the support frame.

There is a great requirement to make a mounting group that allows a user to easily identify it even in poorly lit locations.

SUMMARY OF THE INVENTION

Such a requirement is satisfied through a support frame as defined in the attached first claim in its most general form and in the dependent claims in some particular embodiments.

BRIEF DESCRIPTION OF THE DRAWINGS

The invention shall be better understood from the following detailed description of two embodiments thereof given as an example and, therefore, in no way limiting, referring to the attached drawings, in which.

In the figures, identical or similar elements shall be indicated through the same reference numerals.

DETAILED DESCRIPTION OF PREFERRED EMBODIMENTS

Figure 1:
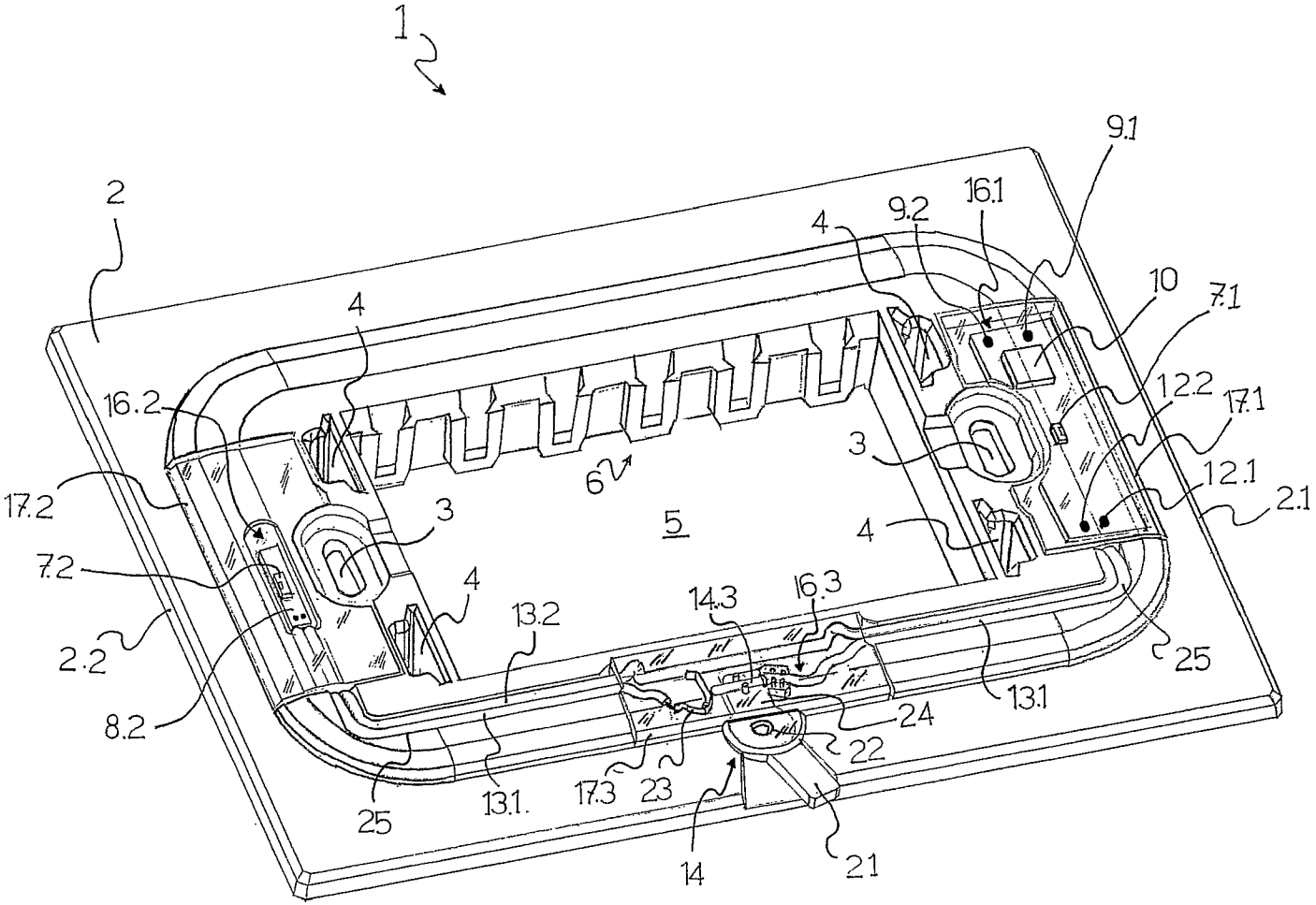
FIG. 1 is an axonometric view of a particularly preferred embodiment of a support frame in accordance with the present invention.

In FIG. 1 a particularly preferred embodiment of a support frame in accordance with the present invention is shown.

The support frame, globally indicated with 1, includes a frame body 2, preferably made from insulating material and having approximately the shape of a substantially plate-shaped framework, for example, in a non-limiting way, with quadrangular plan.

The support frame 1 includes means for fastening to the wall, for example it includes a pair of holes 3 passing through the body 2 of the frame 1, preferably slotted, suitable for receiving respective screws to fix the support frame 1 to a box built in to the wall.

The support frame 1 also includes coupling means for coupling the frame 1 with a cover plate, not represented in FIG. 1. In the example represented in FIG. 1, such coupling means in a non-limiting way are in the form of four coupling channels 4 suitable for receiving respective fastening tabs foreseen in the cover plate.

As is known to men skilled in the art, the role of such a cover plate is both that of ensuring a minimum protection for the electrical apparatuses, for example from dust, and that of preventing dangerous access (for example through pointed objects) to the electrically conducting parts of the electrical apparatuses. Another fundamental task assigned to the cover plates is also that of masking unpleasant sights produced for example by the presence of a recess in the wall, and by the presence of the box and of the mounting frame that, rather than having an aesthetic value, have a functional value that is difficult to combine with aesthetic requirements or standards.

The body 2 of the frame 1 extends around a main opening 5, defining a mounting seat suitable for receiving or holding one or more electrical apparatuses, not represented in FIG. 1. A plurality of hooking elements 6 project from the body 2 of the support frame 1 towards said opening 5, preferably along two parallel edges of the body 2 of the frame 1 that define such an opening 5. Such hooking elements 6 are such as to cooperate with corresponding hooking elements foreseen on two opposite sides of the electrical apparatuses to be hooked to the support frame 1. Preferably, the hooking elements 6 allow hooking of the interlocking type of the electrical apparatuses to the support frame 1 to be carried out.

Advantageously, the support frame 1 includes at least one optical source 7.1, 7.2 suitable for emitting an optical signal having at least one portion of spectrum in the visual range.

Preferably, such an optical source 7.1, 7.2 is an opto-electronic device, preferably of the LED type, for example with emission in the blue range. In a particularly preferred embodiment, such an optical source includes a first LED device 7.1 and a second LED device 7.2, arranged on respective sides of the body of the frame 2, opposite to the opening 6. Preferably, but not in a limiting way, the LEDs 7.1 and 7.2 are miniaturised devices made with surface mounting technology (SMT). From this point on, in the present description reference shall be made to the particular example in which the support frame includes two optical sources, without for this reason introducing any limitation upon the number of sources used.

Advantageously, the support frame 1 also includes an electrical circuit suitable for providing the optical sources 7.1, 7.2 with an electrical power supply signal. Preferably, at least one part of the electrical circuit is made on one or more printed circuits that also acts as a support for the optical sources. In the example of FIG. 1, since the support frame 1 includes two optical sources 7.1, 7.2, the electrical circuit includes two printed circuit boards, 8.1 and 8.2, on each of which a respective LED 7.1, 7.2 is welded. It should be observed that in FIG. 1 the LEDs are fixed onto the printed circuit boards on their side facing towards a possible cover plate to be fixed to the frame. Alternatively, the optical sources could be mounted onto the printed circuit boards on their side intended to face the mounting wall for the support frame 1.

Figure 2:
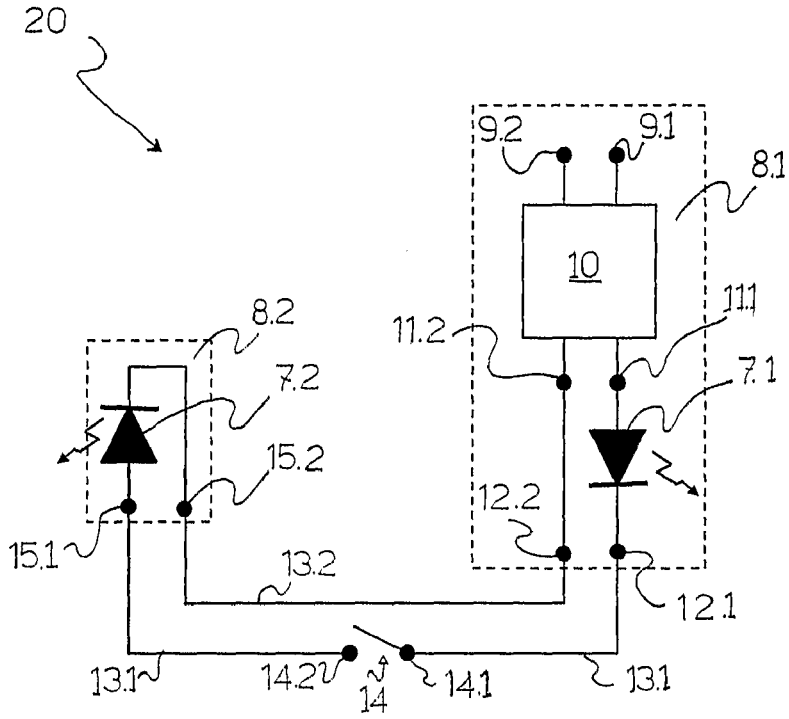
FIG. 2 is a simplified circuit diagram of the support frame of FIG. 1.

The circuit diagram 20 of the support frame of FIG. 1 is shown in FIG. 2. The electrical circuit of the support frame 1, globally indicated with 20, includes two input terminals 9.1, 9.2, in the example arranged on the first printed circuit board 8.1. These terminals 9.1, 9.2 are such as to receive in input an alternating voltage from the mains power supply, preferably the same alternating voltage that can be fed in input to the electrical apparatuses intended to be fixed to the support frame 1. For example, respective small cables (not shown in the figures) can be welded to the terminals 9.1 and 9.2 to connect such terminals 9.1, 9.2 to the mains alternating voltage.

The electrical circuit 20 also includes a transformation circuit section 10 connected to such input terminals 9.1, 9.2 to receive such alternating voltage in input and transform it into a continuous feed voltage suitable for feeding the LEDs 7.1, 7.2. In particular, the continuous feed voltage is made available to two output terminals 11.1, 11.2 of the transformation circuit section 10. The details of a circuit section 10 suitable for transforming an alternating voltage into a continuous voltage form part of the general background knowledge of a man skilled in the art and for this reason they shall not be described any further.

One of the output terminals of the transformation circuit section 10, i.e. the terminal 11.1, is connected to a terminal of the LED 7.1. The other terminal of the LED 7.1 is connected to a first output terminal 12.1 of the first printed circuit board 8.1.

The other 12.2 of the two output terminals of the transformation circuit section 10 is electrically connected to a second output terminal 12.2 of the first printed circuit board 8.1.

Electrical connection means 13.1, 13.2, 14 are provided in the circuit 20 to connect the first 8.1 and the second 8.2 printed circuit board, and therefore the first 7.1 and the second 7.2 optical source together. Such connection means include, for example, a pair of conducting cables 13.1, 13.2 equipped with insulating sheath. As an alternative to the two conducting cables 13.1, 13.2, to make the connection between the two boards 8.1, 8.2 two conductive tracks printed onto a band of insulating and flexible material could be used.

The conducting cables 13.1, 13.2 are respectively such as to connect the first/second output terminal 12.1, 12.2 of the first printed circuit board 8.1 to a first/second input terminal 15.1, 15.2 of the second printed circuit board 8.2.

The electrical connection means 13.1, 13.2, 14 of the circuit 20 also include switch means 14 for opening/closing the electrical connection between the two printed circuit boards 8.1, 8.2. In the example, such switch means include a switch 14 suitable for connecting/disconnecting two intermediate terminals 14.1, 14.2 of one 13.1 of the two connection cables 13.1, 13.2.

The second LED device 7.2 is connected in series between the two input terminals 15.1, 15.2 of the second printed circuit 8.2.

It should be observed that in practice in the circuit 20 represented in FIG. 2, the two LEDs 7.1, 7.2 and the switch 14 are connected together in series. It should also be observed that such a switch 14 is such as to interrupt/restore a power supply current of the LEDs 7.1 and 7.2, supplied by the transformation circuit section 10.

Going back to the support frame 1 represented in FIG. 1, advantageously, the body of the frame 2, includes one or more pockets or inner chambers, made in the profile of said body 2 to receive the electrical circuit and the optical sources inside of it.

In the example of FIG. 1, the frame body includes two inner chambers 16.1 and 16.2 each of which receives a respective LED 7.1 and 7.2, and a respective printed circuit board 9.1, 9.2. Each inner chamber 16.1, 16.2 is preferably formed from a pocket made in the profile of the frame body 1 and from a cover element 17.1, 17.2, for example substantially plate-shaped, suitable for closing an open side of such a pocket to form a substantially closed chamber 16.1, 16.2.

In a particularly preferred embodiment, the body 2 of the support frame 1 and the cover elements 17.1, 17.2 of the chambers 16.1, 16.2 housing the optical sources 7.1, 7.2 are made from a material substantially transparent to the wavelength of the optical signals emitted by such sources. Preferably, such a material is a hard and transparent plastic. Nevertheless, it should be observed that it is not essential that the entire body 2 of the frame 1, including the cover elements 17.1, 17.2, be made from a transparent material. Indeed, it is sufficient for just a portion thereof be transparent in such a way as to be able to make at least one portion of the optical signals emitted by the sources pass to outside the frame. Of course, it is possible to make a support frame having both transparent parts and opaque parts but it is more expensive, therefore less preferred, than making a frame completely from a transparent material.

Preferably, the optical signals generated by the LED sources escape by propagation outside of the frame body on two peripheral sides 2.1, 2.2 of the frame body 2 opposite to the opening 5.

Preferably, a further inner chamber 16.3 is foreseen in the body 2 of the frame to in part receive the switch 14. This further inner chamber 16.3 is also formed from a pocket provided with an open side and from a cover element 17.3 suitable for closing such an open side to form a substantially closed chamber 16.3.

In the particular example represented in FIG. 1, the switch 14 includes an actuation lever 21 that can rotate about a pin 22. A first intermediate end of the conducting cable 13.1, for example welded to a bent sheet 23, makes a fixed contact element of the switch 14. A second end 14.3 of the conducting cable 13.1, for example welded to a plug, is fixed to a support arm 24 connected to the actuation lever 21 and makes a mobile contact element of the switch 14. The switch 14 can however be different to the particular example of switch described.

In a particularly preferred embodiment, the body 2 of the support frame 1 includes a channel 25, made in the profile of the body 2 of the frame 1, suitable for receiving inside it the electrical connection means 13.1, 13.2 between the first 7.1 and the second 7.2 optical source. Preferably, the channel 25 extends along a side of the opening 5 to place the first inner chamber 16.1 in communication with the second inner chamber 16.2. More preferably, as represented in FIG. 1, the channel 25 crosses the third inner chamber 16.3 housing part of the switch 14.

Figure 3:
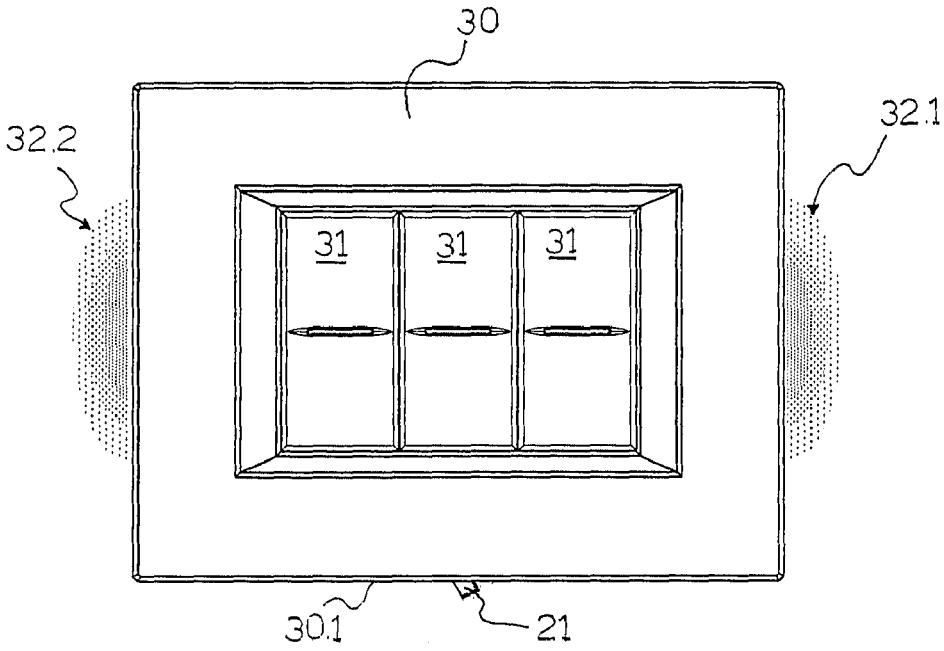
FIG. 3 shows a front view of a cover plate and of a group of electrical apparatuses applied to the support frame of FIG. 1.

FIG. 3 shows a cover plate 30 fixed to the support frame 1. Three electrical apparatuses, for example three button-actuated switches 31, are installed in the mounting seat of the support frame 1. The mounting frame 1 has its front portion completely covered by the cover plate, and for this reason it cannot be seen in FIG. 3, with the exception of the actuation lever 21 that projects from a lower edge 30.1 of the cover plate 30.

As can be seen in FIG. 3, the cover plate 30 acts as an opaque screen for the optical signals emitted by the optical sources 7.1, 7.2, in other words, the cover plate is made from a material substantially not transparent to the wavelength of the optical signals emitted by the two sources 7.1 and 7.2. Two optical beams of the diffused type 32.1 and 32.2, emitted by the optical sources 7.1, 7.2, starting from inside the chambers 16.1 and 16.2 cross the body 2 of the frame 1 to go out from the edge walls 2.1, 2.2 of the body 2 of the frame 1 and project onto a wall on which the frame, the electrical apparatuses and the plate are fixed.

It is possible to understand how a support frame in accordance with the present invention makes it particularly easy to locate the electrical apparatuses mounted at the support frame also without external lighting, creating, moreover, a pleasant aesthetic effect.

Of course, the man skilled in the art can mane numerous modifications and variations to the support frame described above, in order to satisfy contingent and specific requirements, all of which are in any case covered by the scope of protection of the invention as defined by the following claims.

The invention claimed is:

1. Support frame for wall-mounting at least one electrical apparatus, the frame comprising:

a substantially plate-shaped frame body that can be fixed to a wall and extending around an opening defining a mounting seat suitable for receiving and holding said at least one electrical apparatus, said frame body having a profile and including a rear side for facing the wall, an opposing front side and at least one edge wall interposed between said rear and front sides;

means for fastening to the wall including a plurality of holes passing through said frame body;

coupling means including a plurality of coupling channels, for coupling the frame with a cover plate;

a plurality of hooking elements projecting from said frame body towards said opening for cooperating with said at least one electrical apparatus for hooking said electrical apparatus to the support frame;

a first and a second optical sources suitable for generating an optical signal;

an electrical circuit comprising electrical connection means between said first and second optical sources, connected to said sources and operative for providing an electrical power supply signal to said sources;

housing means provided within the profile of said frame body for housing said electrical circuit and said sources, said housing means comprising a first inner chamber housing said first optical source and a second inner chamber housing said second optical source; and a channel provided in the profile of said frame body for receiving the electrical connection means, the channel extending along a side of the opening to place the first inner chamber in communication with the second inner chamber, said frame body comprising at least a portion thereof which is substantially transparent to the wavelength of the optical signal emitted by said optical sources and allowing for propagation of at least a part of the optical signal towards the outside of the frame body across said edge wall by passing through said substantially transparent portion so as to project said part of the optical signal onto the wall on which the support frame is fixed when said cover plate is coupled to the frame body so as to frontally cover said optical sources, wherein said cover plate is substantially not transparent to the wavelength of the optical signal emitted by said optical sources.

2. Support frame according to claim 1, wherein said frame body is completely made from a material substantially transparent to the wavelength of said optical signal.

3. Support frame according to claim 2, wherein said frame body is made from transparent plastic.

4. Support frame according to claim 1, wherein said electrical circuit includes at least one printed circuit board and wherein each of said optical sources includes an surface mounting LED fixed to said printed circuit board.

5. Support frame according to claim 1, wherein said electrical circuit includes two terminals to receive in input an alternating voltage that can be fed to said at least one electrical apparatus, said electrical circuit also including a circuit section to transform said alternating voltage into a continuous feed voltage for said optical sources.

6. Support frame according to claim 1, wherein said electronic circuit includes switch means connected in series to said optical sources to interrupt/restore said electrical power supply signal.

7. Support frame according to claim 1, wherein said opening has a substantially quadrangular shape and wherein said first and second optical sources include a first and a second opto-electronic devices arranged respectively on a first side and on a second side of said opening which are opposed to each other.

8. Support frame according to claim 7, wherein said first and said second opto-electronic devices are connected in series with each other and wherein said electrical connection means extends along a third side of said opening.

9. Support frame according to claim 8, wherein said frame body includes a channel extending along the extension of said third side, suitable for receiving said electrical connection means.

10. Support frame according to claim 1, wherein the support frame is part of a group of parts further comprising a cover plate adapted to be coupled to said frame body so as to frontally cover said optical sources.

11. A support frame and cover plate assembly for wall-mounting an electrical apparatus, the support frame comprising:

a substantially plate-shaped frame body circumscribing an opening defining a mounting seat for receiving and holding at least one electrical apparatus, said frame body including a rear side for facing a wall, an opposing front side and an edge wall interposed between said rear and front sides;

means for fastening the frame body to the wall;

coupling means for coupling the support frame with said cover plate a plurality of hooking elements projecting from said frame body towards said opening for cooperating with and mounting said at least one electrical apparatus;

a first and a second optical sources for emitting an optical signal having a wavelength; and an electrical circuit operative for providing power to said optical sources;

housing means provided within the profile of said frame body comprising a first inner chamber housing said first optical source and a second inner chamber housing said second optical source, wherein said cover plate is substantially opaque to the wavelength of the emitted optical signal and adapted to couple to the support frame and frontally cover the emitted optical signal, and wherein at least a portion of said edge wall is substantially transparent to the wavelength of the emitted optical signal, allowing at least a part of the emitted optical signal to pass therethrough and illuminate at least a portion of the wall peripheral to support frame.

* * * * *